US009144324B1

(12) United States Patent
Champagne et al.

(10) Patent No.: US 9,144,324 B1
(45) Date of Patent: Sep. 29, 2015

(54) BALANCING BABY WALKER

(71) Applicants: Bruce Champagne, New York, NY (US); Jesse D. Horowitz, New York, NY (US)

(72) Inventors: Bruce Champagne, New York, NY (US); Jesse D. Horowitz, New York, NY (US)

( * ) Notice: Subject to any disclaimer, the term of this patent is extended or adjusted under 35 U.S.C. 154(b) by 0 days.

(21) Appl. No.: 14/626,590

(22) Filed: Feb. 19, 2015

Related U.S. Application Data

(60) Provisional application No. 62/011,143, filed on Jun. 12, 2014.

(51) Int. Cl.
*A47D 13/04* (2006.01)
*A47D 13/08* (2006.01)
*A47D 15/00* (2006.01)

(52) U.S. Cl.
CPC ..... *A47D 13/043* (2013.01); *A47D 13/08* (2013.01); *A47D 15/006* (2013.01)

(58) Field of Classification Search
CPC ... A47D 13/04; A47D 13/043; A47D 13/046; A47D 13/10; A47D 13/107
USPC ..... 280/87.051; 472/135; 297/5, 274, 297/DIG. 11
See application file for complete search history.

(56) References Cited

U.S. PATENT DOCUMENTS

| | | | | | |
|---|---|---|---|---|---|
| 517,403 | A | * | 3/1894 | Bradish et al. | 280/87.03 |
| 1,223,707 | A | * | 4/1917 | Lyon | 280/87.05 |
| 3,083,050 | A | * | 3/1963 | Gill | 297/16.1 |
| 3,145,048 | A | * | 8/1964 | Dowdy et al. | 297/5 |
| 3,183,028 | A | * | 5/1965 | Williams | 293/127 |
| 3,884,495 | A | * | 5/1975 | Petock | 280/87.041 |
| 4,231,582 | A | * | 11/1980 | Moss | 280/87.051 |
| 4,342,465 | A | * | 8/1982 | Stillings | 280/87.051 |
| 4,359,242 | A | * | 11/1982 | Gerken et al. | 297/5 |
| 4,699,392 | A | | 10/1987 | Ku | |
| 5,203,581 | A | | 4/1993 | Jankowski | |
| 5,366,231 | A | * | 11/1994 | Hung | 280/87.051 |
| 5,449,185 | A | | 9/1995 | Sykes | |
| 5,526,893 | A | * | 6/1996 | Higer | 180/65.1 |
| 5,590,892 | A | * | 1/1997 | Hu | 280/87.051 |
| 5,732,961 | A | | 3/1998 | Theodoropoulos | |
| 5,857,944 | A | * | 1/1999 | Cone et al. | 482/66 |
| 8,182,355 | B2 | * | 5/2012 | Bapst et al. | 472/103 |
| 8,967,642 | B2 | * | 3/2015 | Bagheri | 280/87.041 |
| 2003/0184036 | A1 | * | 10/2003 | Wu | 280/87.051 |
| 2004/0075231 | A1 | | 4/2004 | Hou et al. | |
| 2004/0119258 | A1 | * | 6/2004 | Yoo | 280/87.051 |
| 2008/0012409 | A1 | * | 1/2008 | Chen et al. | 297/274 |

* cited by examiner

*Primary Examiner* — John Walters
*Assistant Examiner* — Brian Swenson
(74) *Attorney, Agent, or Firm* — Frank Marino

(57) ABSTRACT

A device for helping babies learn to walk properly consists of a wheeled frame that surrounds the baby, a harness that affixes to or more closely envelopes the baby, and an elastic support extending from the frame to the harness to bias the harness, and thus the baby, centrally within the frame. A braking mechanism prevents mobility except when the baby stands and balances, thus inspiring the baby to actually walk, and developing the baby's sense of balance and walking muscles.

17 Claims, 3 Drawing Sheets

BALANCING BABY WALKER

RELATED APPLICATION

This application is a Continuation of and claims benefit to U.S. Provisional Application Ser. No. 62/011,143 filed on Jun. 12, 2014, the entire teachings of which are incorporated herein by reference in their entirety.

FIELD OF THE INVENTION

The present invention is related to devices and methods for assisting babies to learn to walk.

BACKGROUND

"Baby walker" is a term used generically to describe common and well-known devices of three main types; unattended sit-in-walkers, unattended push walkers, and parent-assisted walkers (such as those employing lead strings). When used herein with reference to prior art walkers, the generic term "baby walker" is meant to refer to those such as pictured in U.S. Pat. No. 5,449,185, which include a central seat that allows a baby to sit with his/her feet touching the floor, so that pushing against the floor with his/her feet will cause the device to roll about the floor. The goal of such devices is that the baby will gradually learn to walk by such an activity. But such a goal has, as yet, never been realized. In fact, the American Academy of Pediatricians supports a ban on such "baby walkers", as they are believed to actually prevent the development of the torso muscles and cause back pain, ironically delaying the time it takes for a baby to learn to walk in comparison to natural unaided development (see http://www.childrenshealthnetwork.org/CRS/CRS/pa_walkers_pep.htm).

Despite the name, baby walkers let babies simulate walking but don't really help them acquire walking skills. Indeed, according to the American Academy of Pediatrics (AAP), walkers can delay normal motor and mental development. In fact, one study found strong associations between the amount of walker use and the extent of developmental delay (see www.consumerreports.org/cro/baby-walkers/buying-guide.htm).

To enable progress from the crawling stage of life to walking, a baby must develop a sense of balance. Balance is essential to enable the child to stand up unassisted and to walk without falling. Currently, because existing baby walkers allow the baby to gain mobility without standing, such a sense of balance is not developed. The ability to move while sitting risk-free in current devices does not encourage the baby to seek mobility by standing and walking.

In addition, because of the seated position in current devices, babies oftentimes can only move their legs from the knee joint. They cannot use, and therefore do not exercise, develop, and strengthen the quad muscles which are essential for walking (see https://sciencequestionswithchris.wordpress.com/2013/04/09/how-do-baby-walkers-teach-a-baby-to-walk-sooner/).

There exists a need for a device and method for teaching babies to walk by developing their sense of balance, inspiring them to seek mobility while standing, and developing their "walking" muscles, and such are features and objects of the present invention. There exists a need for a device and method to discourage babies from expecting mobility while seated, from failing to develop their sense of balance, and from improperly developing their "walking" muscles, and such are features and objects of the present invention. There exists a need for a device which prevents mobility when a baby is seated or imbalanced, to thereby encourage standing and balance, and such are features and objects of the present invention. Further needs and objects exist which are addressed by the present invention, as may become apparent by the included disclosure of an exemplary embodiment thereof.

SUMMARY OF THE INVENTION

The present invention may be exemplified by or practiced using a balancing baby walker which increases stability to improve safety and accelerate learning to walk, which gives babies a sense of balance and confidence. The present invention allows a parent to safely allow the baby to be in and learn to walk in this device without a parent assisting and guiding the baby. The present invention inspires babies to stand and rewards them when they do, and rewards them as their balance improves. The present invention allows mobility only when the baby is standing and properly balanced to discourage sitting and to inspire and reward proper walking form, and to cause proper muscle development and proper leg and foot alignment. The present invention prevents mobility when the baby is not standing and properly balanced, to improve safety. These features and others, individually and in combination, provide a safe and effective way to perfect early ambulation.

The invention may be embodied in or practiced by a baby walker including a mobile frame that surrounds the baby, a harness system that envelopes the baby, and an elastic support system extending from the frame to the harness system to suspend the harness system within the frame and bias the harness system, and thus the baby, centrally within the frame. The elastic support system may be a plurality of elastic bands surrounding the harness system. The elastic bands may be from the group including rubber bands, plastic bands, extension springs, and compression springs. Or the elastic support system may be an elastic membrane continuously or discontinuously surrounding the harness. The elastic membrane may be made of, but not limited to, a material from the group including rubber, TPR, TPE, vinyl, and silicone. Or the elastic support system may be an elastic web continuously or discontinuously surrounding the harness. The elastic web may be made of elastic netting.

The mobile frame may include a railing continuously or discontinuously surrounding the baby outside of the baby's reach. The railing may define a center point, and may be disposed entirely beyond the reach of the baby's extended arm, at least fifteen inches beyond the center point. The railing may be disposed forwardly, or only forwardly and rearwardly, on the walker and not disposed at left and right sides thereof. The railing may include out-of-reach attractants. The out-of-reach attractants may be disposed on a forward portion of the railing.

The baby walker may have at least one compression spring braking element for selectively engaging a support surface to prevent relative mobility between the baby walker and the support surface. The at least one compression spring braking element may be configured to not engage the support surface when the baby assumes a standing or walking position. The mobile frame may include a lower ring disposed parallel to the support surface, and the lower ring may include a plurality of mobility wheels and the at least one compression spring braking element. The plurality of mobility wheels with integrated compression spring brakes may be configured to only provide mobility to the frame relative to the support surface only when the baby assumes a standing or walking position.

The frame may be adjustable to enable a compact storage configuration and at least one extended position. The at least one extended position may be a plurality of extended positions each causing a different walker height. The frame may be smaller in side-to-side dimension than in front-to-back dimension.

The invention may also be embodied in or practiced by a device for training babies to walk and including; 1) a lower ring having a plurality of wheels extending downwardly there-from towards and in contact with a support surface, the wheels being retractably affixed to the ring by springs, and the ring having at least one braking element which engages the support surface when the wheels are retracted, 2) a stand connected to and disposed above the lower ring, and foldable to provide height adjustability, 3) a railing affixed to the stand at least at upper forward and upper rearward portions thereof, 4) a harness for receiving a baby in both standing and sitting dispositions, the harness disposed approximately centrally within the device, and 5) an elastic support extending from the railing to the harness to support the harness centrally within the device and to bias the harness, and thereby bias the baby, towards the central position. At least one of the wheels may be retracted and the at least one braking element may engage the support surface to prevent mobility between the device and support surface when the baby sits in the harness, as a result of his weight acting on the springs. And at least one of the wheels may extend and the at least one braking element may disengage from the support surface to allow mobility between the device and the support surface when the baby does not sit. At least one braking element may engage when the baby leans too far over in any direction, thus placing weight on the support surface forcing the wheel to retract and the brake to engage.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
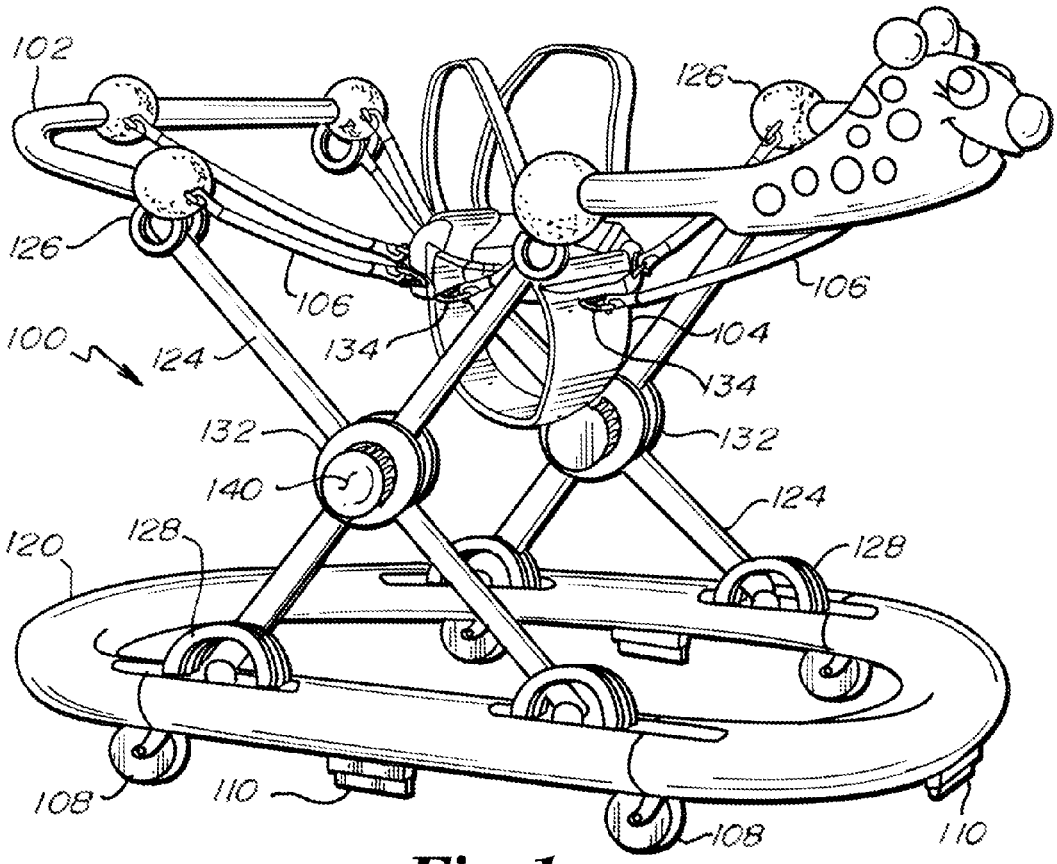
FIG. 1 is a perspective view of an exemplary balancing baby walker according to or for use in practicing the invention.
Figure 2:
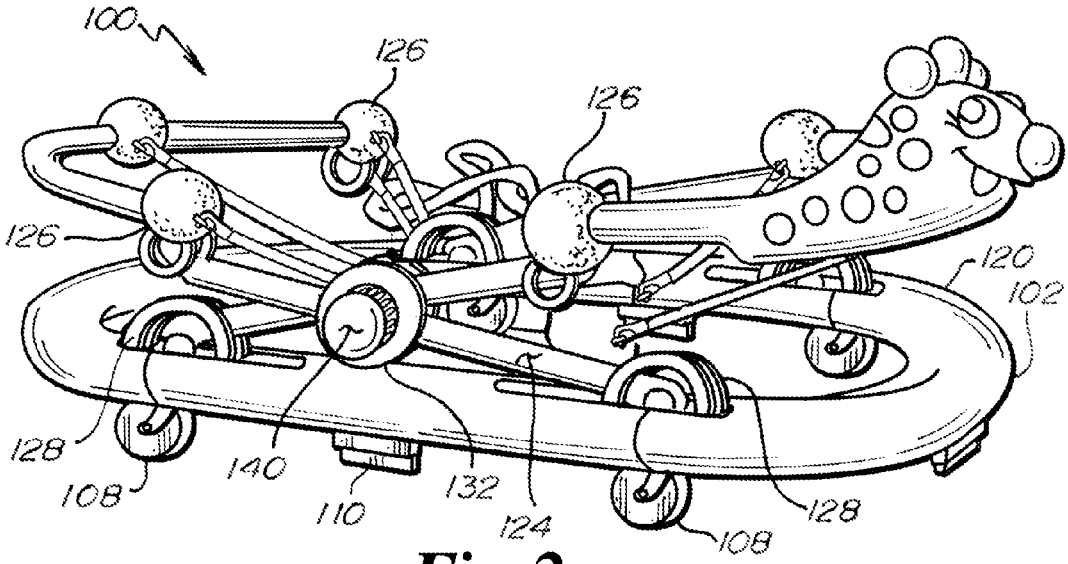
FIG. 2 is a perspective view of the balancing baby walker of FIG. 1 in a folded-down condition for less voluminous shipping and storage.

Reference is first made to FIGS. 1 through 6B, where there is shown an exemplary baby walker 100 according to the invention. The walker includes a frame 102, a harness 104, and an elastic support 106.

The frame includes wheels 108 to provide mobility under certain conditions. The frame also includes rubber braking elements 110 to engage the floor and prevent mobility under certain other conditions.

The frame also includes an upper railing 112. The upper railing discontinuously surrounds a baby 200 at approximately waist height, along a circular or elliptical outline that is just beyond arm's reach from the baby when standing centrally therein. The railing includes an arcuate forward portion 114F, an arcuate rear portion 114B, and right and left side voids, 114R and 114L respectively. The arcuate forward portion includes a dashboard 116 including various attractants 118 that inspire the baby to stand and reach forwardly. The attractants may include flashing lights, colorful objects, characters, mechanical and/or spring-loaded moving objects, or such.

The left and right side voids eliminate any incentive or opportunity for the baby to improperly seek side support, thereby inspiring him to either balance upright or to lean forwardly towards the dashboard.

Figure 3:
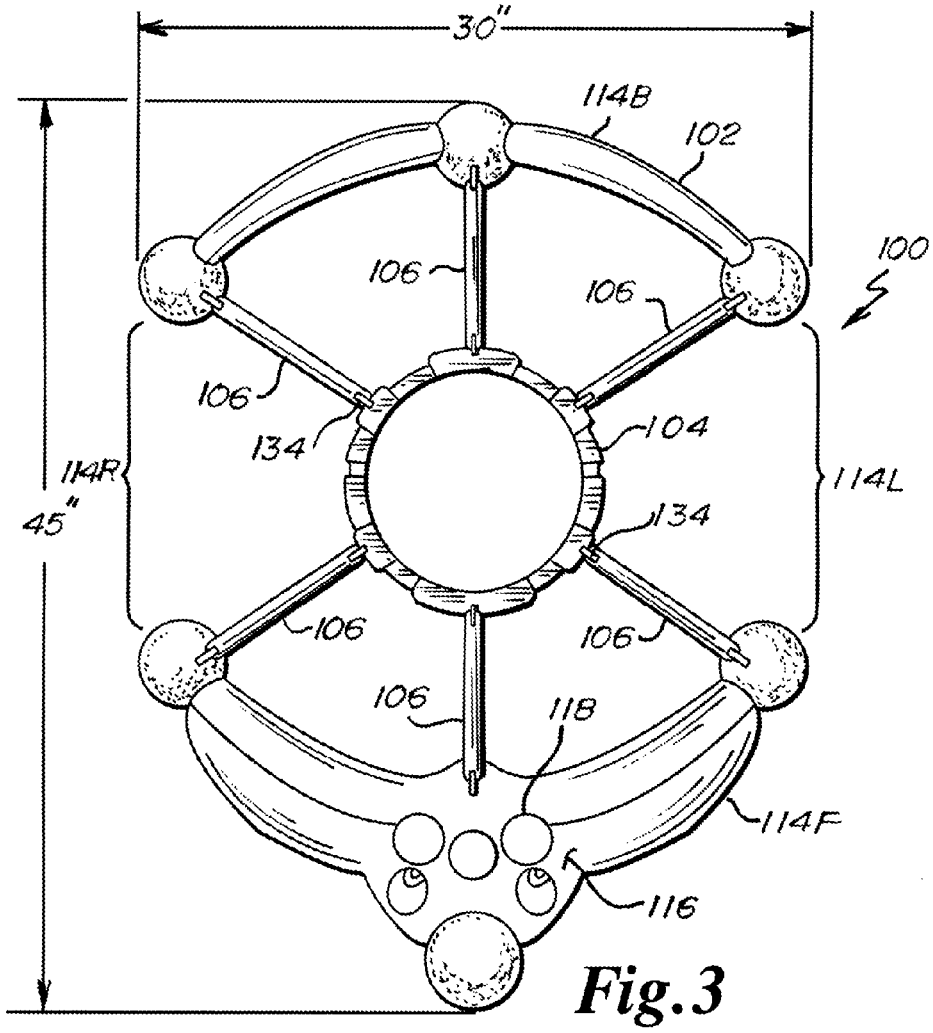
FIG. 3 is a partial top view of the balancing baby walker of FIG. 1.

The left and right side voids also result in a thinner, more streamlined arrangement, as appreciated by viewing the plan view of FIG. 3. The walker may thereby be longer front-to-back that it is wide side-to-side, to thereby maximize stability without being too wide to fit through doorways and such. The upper railing is preferably encased in a soft foam material, such as EVA, to increase safety and prevent damage to furnishings and such. As embodied, it is also ornamented to give the impression of a fun device such as an animal or other styling type of feature.

The frame also includes a lower ring 120 disposed just above and parallel to the floor 202 on which the walker is used, supported there-above by the wheels or by the braking elements. The lower ring is preferably circular or elliptical.

The upper railing and lower ring of the frame are connected by a stand 124, which is height-adjustable and lockable into numerous heights according to the size of the baby. The walker is used when in a "use" configuration such as that of FIG. 1, but may be unlocked and changed to a different height, or unlocked and folded into the compact "storage" configuration of FIG. 2, for reduced volume during shipping and storage. The stand employs a scissors-type folding arrangement to ensure the railing and ring are always maintained relatively parallel. The stand is hingedly connected to the upper railing by foam-covered hinges 126, and is connected to the lower ring by sliding hinges 128.

The harness 104 is disposed centrally within the frame and is adjustable to loosely surround babies of various sizes. The harness provides "emotional" and safety support at all times. It is not intended as a seat during use.

The harness is supported in its central position within the frame by the elastic support 106. In the exemplary embodiment, the elastic support is a plurality of elastic straps, but could alternatively be a thin elastic membrane, and elastic web (such as elastic netting), extension or compression springs, or any equivalently-functioning arrangement that elastically biases the harness, and the baby within it, back towards the central position within the frame when the baby leans too far in any direction or otherwise starts to lose balance. When elastic bands or an elastic membrane are employed, they may be made of TPR, TPE, Vinyl, Silicone, rubber, bungee cords, or any other suitable type of stretchable material. When a membrane or elastic netting is used, it could completely or discontinuously surround the baby. As embodied herein, the elastic straps include clips 134 which enable the harness to be removed such as for cleaning.

For use, walker 100 is opened into the "use" configuration of FIG. 1. Unlock buttons 140 of hubs 132 of the stand are depressed so that the stand can flex, and the buttons lock automatically when released as the stand is opened to its desired configuration. The walker is preferably placed on a hard and even floor 202, and the baby 200 is lowered into the harness and helped into a balanced standing position. Initially, especially if the baby has some experience with a prior art baby walker, he may futilely attempt to sit and push against the floor to cause mobility.

Figure 6A:
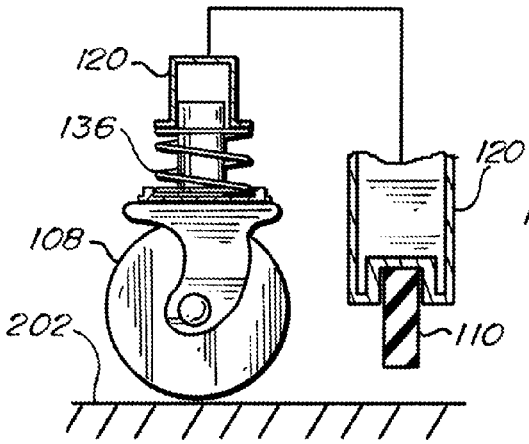
FIG. 6A is a schematic cross sectional view of the rolling/braking system of the balancing baby walker of FIG. 1 during mobility.
Figure 6B:
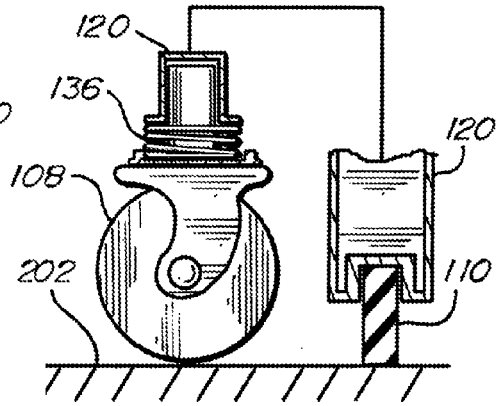
FIG. 6B is a schematic cross sectional view of the rolling/braking system of the balancing baby walker of FIG. 1 during braking.
Figure 5:
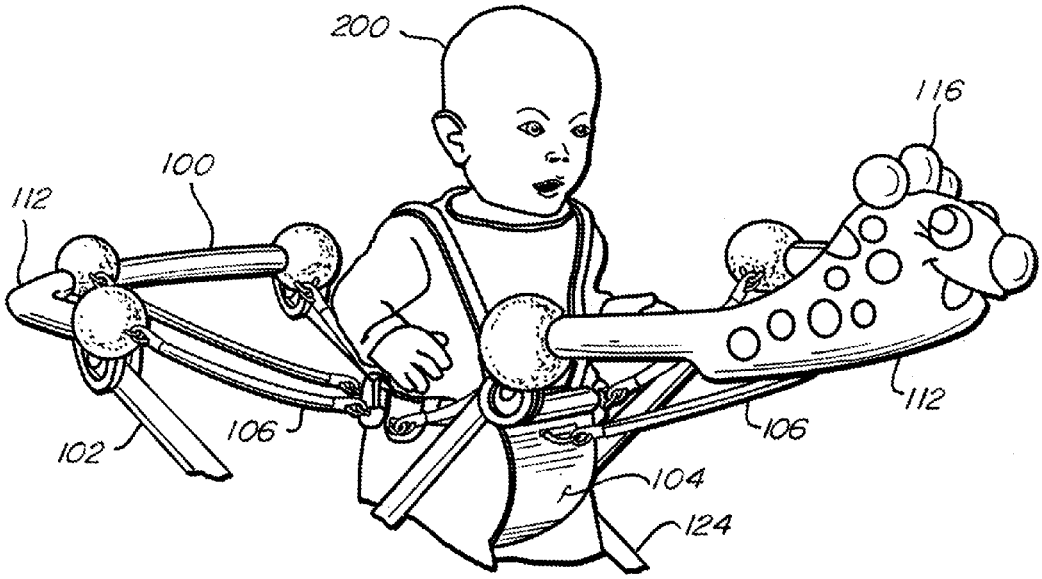
FIG. 5 is a partial perspective view of a baby within the balancing baby walker of FIG. 1.
Figure 4:
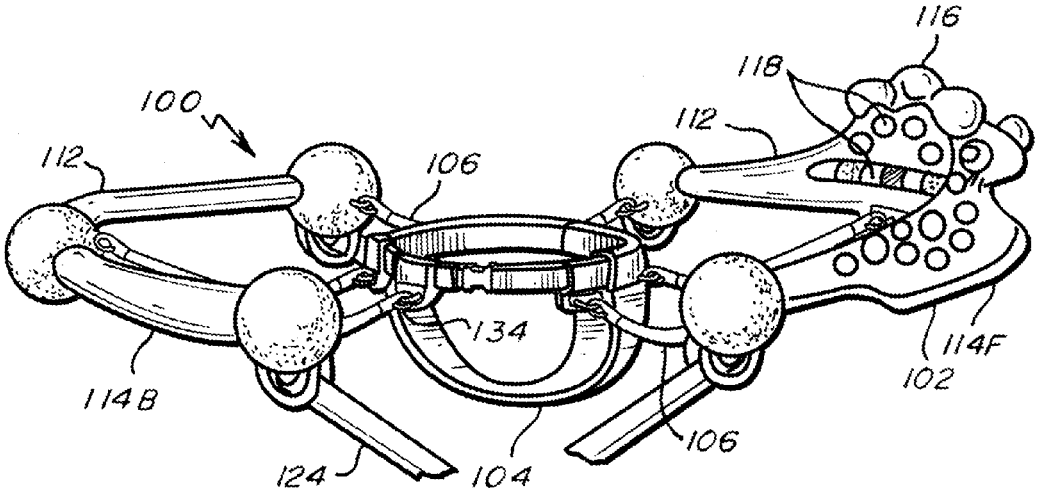
FIG. 4 is a partial close-up perspective view of the balancing baby walker of FIG. 1.

When the baby stands, compression springs 136 are relaxed, causing the wheels to extend downwardly and engage the floor, as seen in FIG. 6A. While the extended wheel may swivel and allow the walker to move side to side, the lack of left and right support as a result of the left and right voids of the upper railing dissuade the baby from attempting to lean to the sides. The baby seeks support from the front arcuate portion of the upper railing and is inspired to lean there-towards, but it is just beyond his reach. And even if the baby is not intending to move, the attraction created by the attractants on the dashboard inspire him to reach forwardly, inadvertently inspiring him to stand and lean forwardly, and he quickly learns that this provides forward mobility. The baby is inspired to stand, gain balance, and lean slightly forwardly to walk, and proper muscular development and leg/foot alignment is a favorable byproduct. But the baby may not reach the upper railing, so the pure act of standing, leaning and reaching results in walking.

The harness and elastic support provide a "safety net" to prevent injury when the baby does inadvertently lean too far. The baby is prevented from leaning far enough to fall, and he is assisted back towards a standing position by the elastic support and his own muscles. When leaning too far in any direction, the elastic support bands gently stop the baby and will gently help pull the baby back into an upright standing position. This helps develop torso and leg muscles, balance, and confidence.

When the baby leans to a certain degree, his weight causes the compression of springs 136 to thereby allow the braking elements to move downwardly and engage the floor. The braking elements preferably are rubber or may be of some similar material, to grip the floor without marking it.

This balancing baby walker is found to advance the timeline of a baby's ambulation in complete safety from falling and injuring himself, and without outside assistance. By being in a standing position, the baby is able to freely move his legs at the hip joint. Thus the device helps the baby develop and strengthen his quad muscles, which are essential in being able to walk upright.

When use is complete and the baby is removed, the frame may be folded back into its "storage" configuration by depressing the unlock buttons in the hubs to allow the stand to fold.

It should be understood that while the invention has been shown and described with reference to the specific exemplary embodiment shown, various changes in form and detail may be made without departing from the spirit and scope of the invention, and that the invention should therefore only be limited according to the following claims, including all equivalent interpretation to which they are entitled.

We claim:

1. A baby walker comprising;

a mobile frame beyond the reach of a baby disposed centrally there-within such that the centrally-disposed baby cannot grasp or lean against the mobile frame to achieve support for standing;

a harness disposed centrally within the mobile frame, that envelopes the baby;

an elastic support extending from the frame to the harness to elastically suspend the harness within the frame and bias the harness, and thus the baby, centrally within the frame;

attractants disposed beyond the centrally-disposed baby's reach on a forward portion of the frame; wherein the mobile frame comprises at least one braking element for selectively engaging a support surface to prevent relative mobility between the baby walker and the support surface, wherein the at least one braking element does not engage the support surface when the baby assumes a standing or walking position;

the mobile frame comprises a plurality of mobility wheels providing mobility to the frame relative to the support surface only when the baby assumes a standing or walking position; whereby the baby is enticed to stand and move forwardly in unsuccessful reach for the attractants, thereby disengaging the at least one braking element from the support surface and enabling the mobility wheels to provide mobility, to enable and cause the baby to walk forwardly, and the mobility wheels are disabled and the braking element engages the support surface when the baby sits or loses balance to thereby prevent mobility.

2. The baby walker of claim 1 wherein the elastic support is a plurality of elastic bands surrounding the harness.

3. The baby walker of claim 2 wherein the elastic bands are one or more from the group comprising rubber bands, plastic bands, extension springs, and compression springs.

4. The baby walker of claim 1 wherein the elastic support is an elastic membrane continuously or discontinuously surrounding the harness.

5. The baby walker of claim 4 wherein the elastic membrane is made of a material from the group including rubber, TPR, TPE, vinyl, and silicone.

6. The baby walker of claim 1 wherein the elastic support is an elastic web continuously or discontinuously surrounding the harness.

7. The baby walker of claim 6 wherein the elastic web is made of elastic netting.

8. The baby walker of claim 1 wherein the mobile frame comprises a railing continuously or discontinuously surrounding the baby outside of the baby's reach.

9. The baby walker of claim 8 wherein the railing defines a center point, and is disposed entirely at least fifteen inches beyond the center point.

10. The baby walker of claim 9 wherein the railing is disposed forwardly on the walker and is not disposed at left and right sides thereof.

11. The baby walker of claim 10 wherein the railing comprises the attractants.

12. The baby walker of claim 11 wherein the attractants are disposed on a forward portion of the railing.

13. The baby walker of claim 12 wherein the mobile frame comprises a lower ring disposed parallel to the support surface, and wherein the lower ring comprises the plurality of mobility wheels and the at least one braking element.

14. The baby walker of claim 1 wherein the frame is adjustable to enable a compact storage configuration and at least one extended position.

15. The baby walker of claim 14 wherein the at least one extended position is a plurality of extended positions each causing a different walker height.

16. The baby walker of claim 1 wherein the frame is smaller in side-to-side dimension than in front-to-back dimension.

17. A device for training babies to walk and comprising;

a lower ring having a plurality of wheels extending downwardly there-from towards and in contact with a support surface, the wheels being retractably affixed to the ring by springs, and the ring having at least one braking element which engages the support surface when the wheels are retracted;

a stand connected to and disposed above the lower ring, and foldable to provide height adjustability, the stand being beyond the reach of a baby disposed centrally therewithin such that the centrally-disposed baby cannot grasp or lean against the stand to achieve support for standing;

attractants disposed beyond the centrally-disposed baby's reach on a forward portion of the stand;

a harness for receiving a baby in both standing and sitting dispositions, the harness disposed approximately centrally within the device; and an elastic support extending from the railing to the harness to elastically support the harness centrally within the device and to bias the harness, and thereby bias the baby towards the central position; wherein at least one of the wheels is retracted and the at least one braking element engages the support surface to prevent mobility between the device and support surface when the baby sits in the harness, as a result of his weight acting on the springs, and wherein at least one of the wheels extends and the at least one braking element disengages from the support surface to allow mobility between the device and the support surface when the baby does not sit; whereby the baby is enticed to stand and move forwardly in unsuccessful reach for the attractants, thereby disengaging the at least one braking element from the support surface and enabling the wheels to provide mobility, to enable and cause the baby to walk forwardly, and the braking element engages the support surface when the baby sits or loses balance to thereby prevent mobility.

* * * * *